US011280470B2

(12) United States Patent
Lee et al.

(10) Patent No.: US 11,280,470 B2
(45) Date of Patent: Mar. 22, 2022

(54) AIR PERMEABLE CAP FOR VEHICLE

(71) Applicants: HYUNDAI MOBIS CO., LTD., Seoul (KR); AMOGREENTECH CO., LTD., Gimpo-si (KR)

(72) Inventors: Jin Won Lee, Yongin-si (KR); Young Ho Lee, Yongin-si (KR); Jun Keun Cho, Gimpo-si (KR); Kyoung Taek Park, Gimpo-si (KR); Hyoung Joo Kim, Gimpo-si (KR); Sang Yeop Shim, Gimpo-si (KR); Sung Pil Cho, Gimpo-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/214,726

(22) Filed: Mar. 26, 2021

(65) Prior Publication Data

US 2021/0302005 A1 Sep. 30, 2021

(30) Foreign Application Priority Data

Mar. 31, 2020 (KR) ..... KR10-2020-0039077

(51) Int. Cl.
*F21S 45/50* (2018.01)
*F21S 45/37* (2018.01)
*F21S 45/33* (2018.01)

(52) U.S. Cl.
CPC ..... *F21S 45/50* (2018.01); *F21S 45/33* (2018.01); *F21S 45/37* (2018.01)

(58) Field of Classification Search
CPC ..... F21S 45/00–70; H05K 5/0213
See application file for complete search history.

(56) References Cited

U.S. PATENT DOCUMENTS

2009/0084078 A1* 4/2009 Furuyama ..... B01D 53/22 55/385.4
2018/0163944 A1* 6/2018 Kim ..... F21S 45/37
2018/0356065 A1* 12/2018 Yano ..... F21S 41/141
2019/0389363 A1* 12/2019 Kim ..... D04H 13/00
2020/0384673 A1* 12/2020 Kitagawa ..... B29C 45/14795

FOREIGN PATENT DOCUMENTS

KR 100564468 B1 3/2006
WO WO-2020075848 A1 * 4/2020 ..... F21S 45/30

* cited by examiner

*Primary Examiner* — Mariceli Santiago
(74) *Attorney, Agent, or Firm* — NovoTechIP International PLLC

(57) ABSTRACT

An air permeable cap for a vehicle may include: a cover part formed in a cylindrical shape with a closed end part, and having a plurality of guide ribs radially formed on an inner circumferential surface thereof; a foam part inserted and installed in the cover part so as to be contacted with the guide ribs, and having a ventilation hole formed on one side thereof; a membrane part installed between the foam part and the cover part, and configured to block a flow of water through the ventilation hole and allow a flow of air through the ventilation hole; and an adhesion retention part coupled in a concave-convex shape to retain an adhesion force between the foam part and the cover part.

11 Claims, 10 Drawing Sheets

AIR PERMEABLE CAP FOR VEHICLE

CROSS-REFERENCE TO RELATED APPLICATION

This application claims priority from and the benefit of Korean Patent Application No. 10-2020-0039077, filed on Mar. 31, 2020, which is hereby incorporated by reference for all purposes as if set forth herein.

BACKGROUND

Field

Exemplary embodiments of the present disclosure relate to an air permeable cap for a vehicle, and more particularly, to an air permeable cap for a vehicle, which includes an adhesion retention part coupled in a concave-convex shape to continuously retain the adhesion force between a foam part made of a rubber material and a cover part made of a plastic material.

Discussion of the Background

An air permeable cap (air vent) for ventilation and waterproof is used in a lamp housing in which a headlight, a turn signal, a tail light and the like of a vehicle are installed or an electric device housing in which various electric control devices of a vehicle are installed.

Such an air permeable cap is installed in a cylindrical opening formed in the housing in which lamps or various electric control devices are installed, and configured to prevent water or dust from being introduced into the housing, suppress a change in internal pressure of the housing due to a temperature change, and discharge gas generated in the housing.

The air permeable cap includes a foam part, a cover part and a membrane part. The foam part is made of a rubber material such that the opening of the housing is inserted therein, the cover part is made of a plastic material and coupled to the foam part, and the membrane part is installed between the foam part and the cover part. When the adhesion force between the cover part and the foam part is weakened by vibration or the like of the vehicle after the air permeable cap is installed in the opening of the housing, the function of blocking the introduction of water or dust may be degraded.

The related art of the present disclosure is disclosed in Korean Patent No. 10-0564468 registered on Mar. 20, 2006 and entitled "Air-Permeable Cap and Outdoor Lamp, Automobile Lamp and Automobile Electrical Component Comprising the Same".

SUMMARY

Various embodiments are directed to an air permeable cap for a vehicle, which includes an adhesion retention part coupled in a concave-convex shape to continuously retain the adhesion force between a foam part made of a rubber material and a cover part made of a plastic material.

In an embodiment, an air permeable cap for a vehicle may include: a cover part formed in a cylindrical shape with a closed end part, and having a plurality of guide ribs radially formed on an inner circumferential surface thereof; a foam part inserted and installed in the cover part so as to be contacted with the guide ribs, and having a ventilation hole formed on one side thereof; a membrane part installed between the foam part and the cover part, and configured to block a flow of water through the ventilation hole and allow a flow of air through the ventilation hole; and an adhesion retention part coupled in a concave-convex shape to retain an adhesion force between the foam part and the cover part.

The adhesion retention part may include: a ring-shaped adhesion protrusion formed along an outer circumference of the foam part; and a plurality of adhesion grooves formed in the respective guide ribs and coupled to the adhesion protrusion.

Each of the guide ribs may have a spacing protrusion which protrudes toward a center of the cover part so as to space the foam part and the membrane part by a predetermined distance apart from the closed end part of the cover part.

The plurality of guide ribs may be each formed to have an L-shaped cross-section.

A pair of guide ribs which are symmetrically disposed to face each other, among the plurality of guide ribs, may constitute one guide rib group, and a first space for ventilation is formed between the pair of guide ribs.

The air permeable cap may include the plurality of guide rib groups, and a second space for ventilation may be formed between the neighboring guide rib groups.

The second space may have a larger width than the first space.

The guide rib groups may be radially arranged on the inner circumferential surface of the cover part so as to be spaced by a predetermined distance apart from each other.

The foam part may be elastically deformable.

Each of the guide ribs may have an inclined coupling guide formed at an end thereof.

The foam part may include: a ventilation part abutting on the membrane part; and a cylindrical coupling part connected to the ventilation part.

The coupling part may have an inclined coupling induction part formed on an end-side inner surface thereof.

In accordance with the embodiment of the present disclosure, the air permeable cap for a vehicle may include the adhesion retention part which is formed in a concave-convex shape to continuously retain the adhesion force between the foam part made of a rubber material and the cover part made of a plastic material.

Furthermore, the air permeable cap may include the spacing protrusions which space the foam part by a predetermined distance apart from the inner surface of the cover part, with the foam part coupled to the cover part, in order to improve the ventilation function.

Furthermore, the guide rib formed on the cover part may expand the flow space between the inner circumferential surface of the cover part and the outer circumferential surface of the foam part, thereby improving the ventilation performance.

DETAILED DESCRIPTION OF THE ILLUSTRATED EMBODIMENTS

Hereinafter, an air permeable cap for a vehicle will be described below with reference to the accompanying drawings through various exemplary embodiments. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 1:
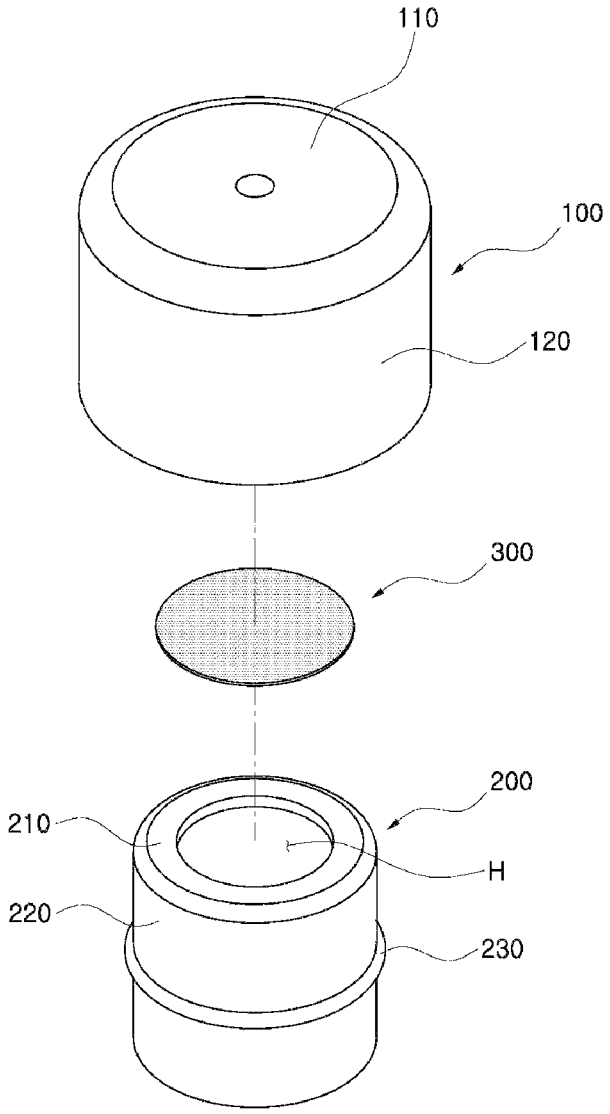
FIG. 1 is a diagram illustrating the state before components constituting an air permeable cap for a vehicle in accordance with an embodiment of the present disclosure are coupled.
Figure 2:
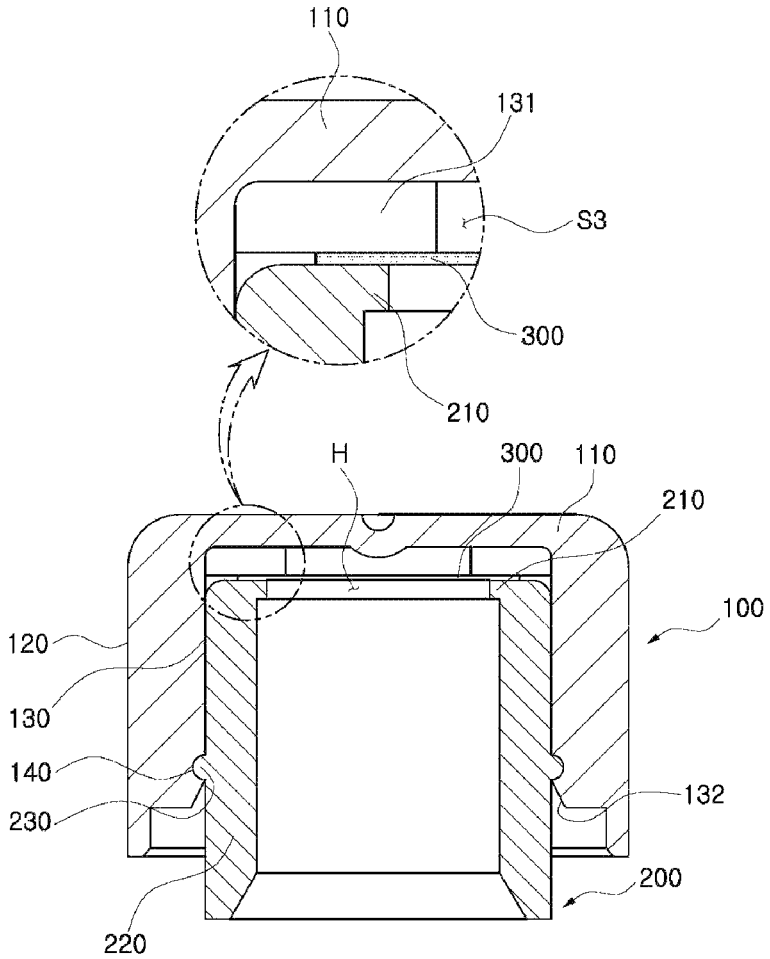
FIG. 2 is a cross-sectional view illustrating the state in which the components constituting the air permeable cap for a vehicle in accordance with the embodiment of the present disclosure are coupled.
Figure 3:
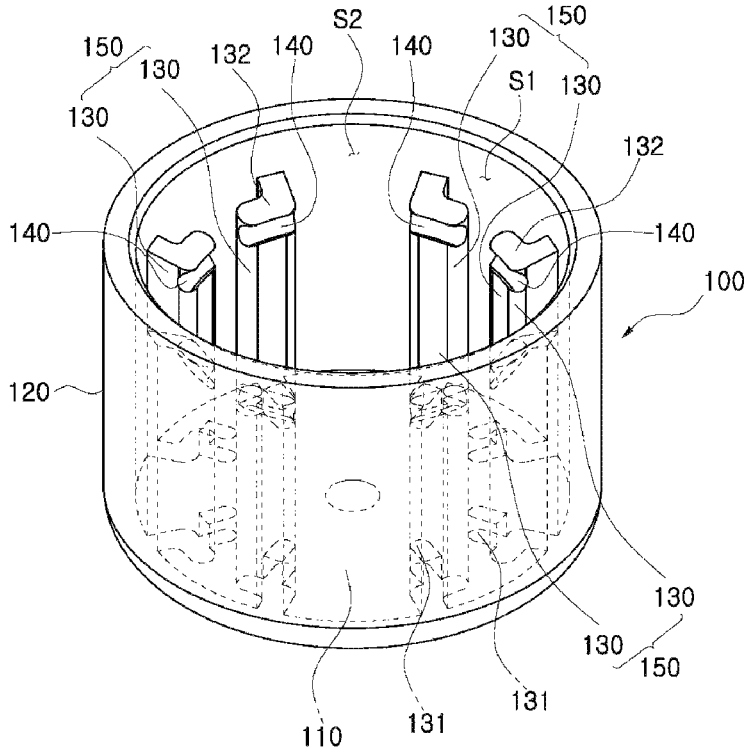
FIG. 3 is a perspective view illustrating a cover part of the air permeable cap for a vehicle in accordance with the embodiment of the present disclosure.
Figure 4:
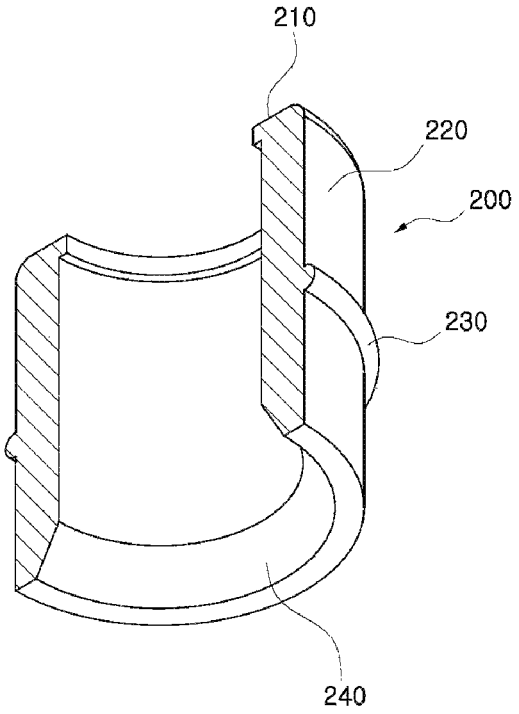
FIG. 4 is a cross-sectional perspective view illustrating a foam part of the air permeable cap for a vehicle in accordance with the embodiment of the present disclosure.
Figure 5:
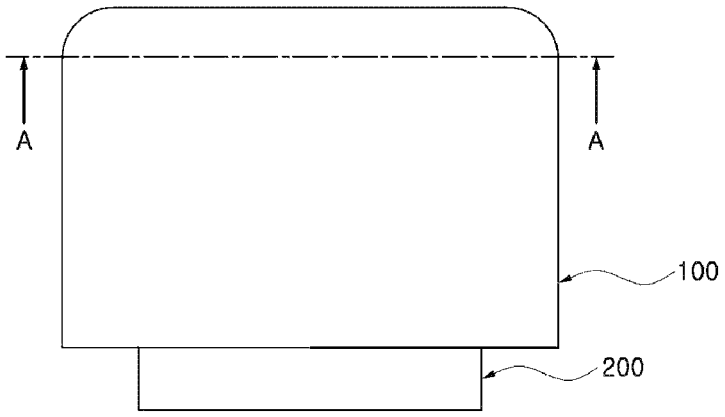
FIG. 5 is a side view illustrating the air permeable cap for a vehicle in accordance with the embodiment of the present disclosure.
Figure 6:
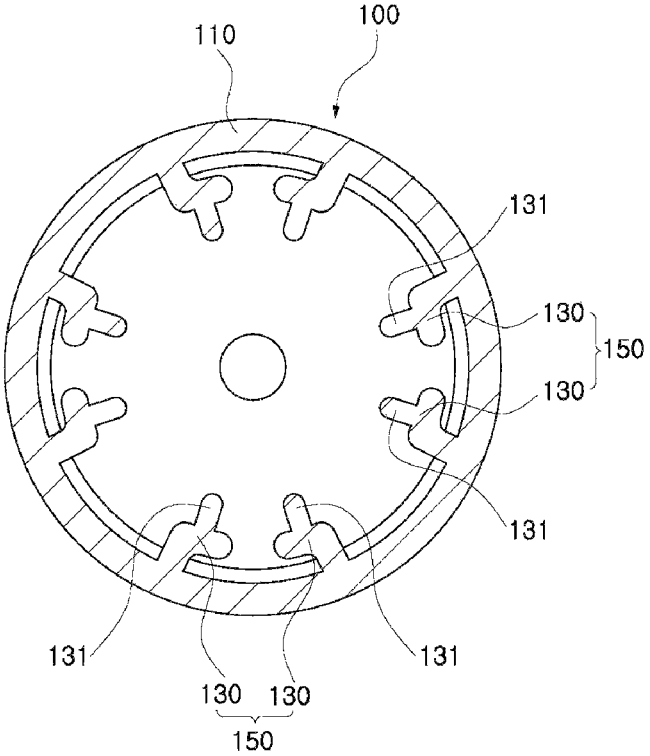
FIG. 6 is a cross-sectional view taken along line A-A of FIG. 5.
Figure 7:
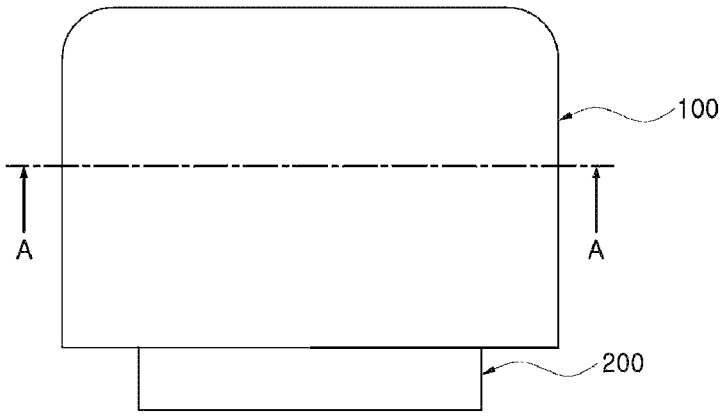
FIG. 7 is another side view illustrating the air permeable cap for a vehicle in accordance with the embodiment of the present disclosure.
Figure 8:
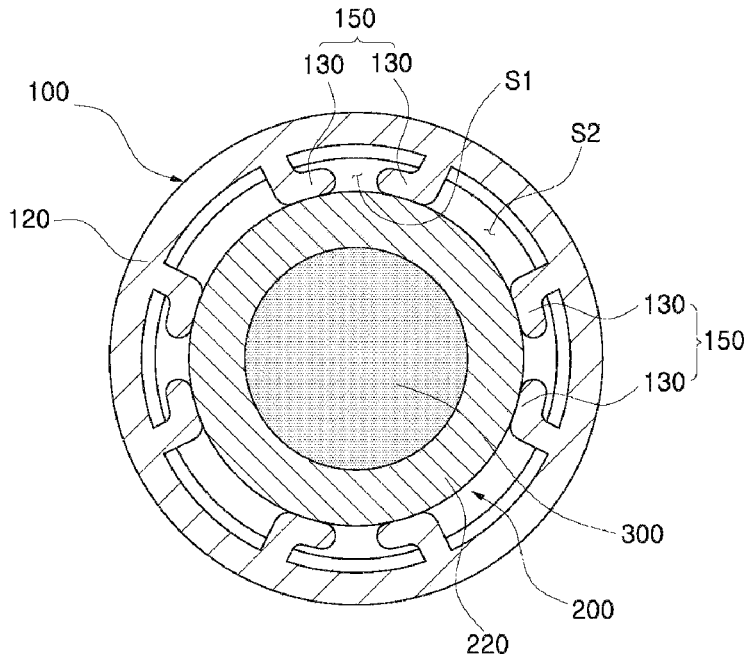
FIG. 8 is a cross-sectional view taken along line A-A of FIG. 7.
Figure 9:
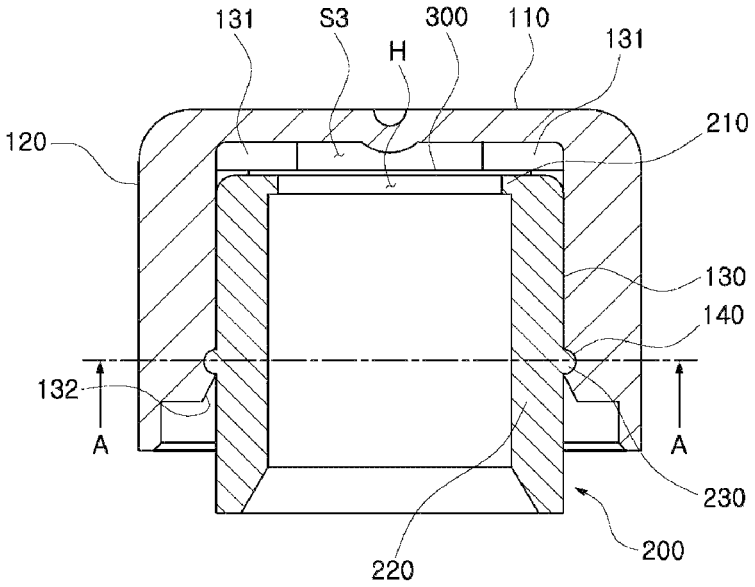
FIG. 9 is still another side view illustrating the air permeable cap for a vehicle in accordance with the embodiment of the present disclosure.
Figure 10:
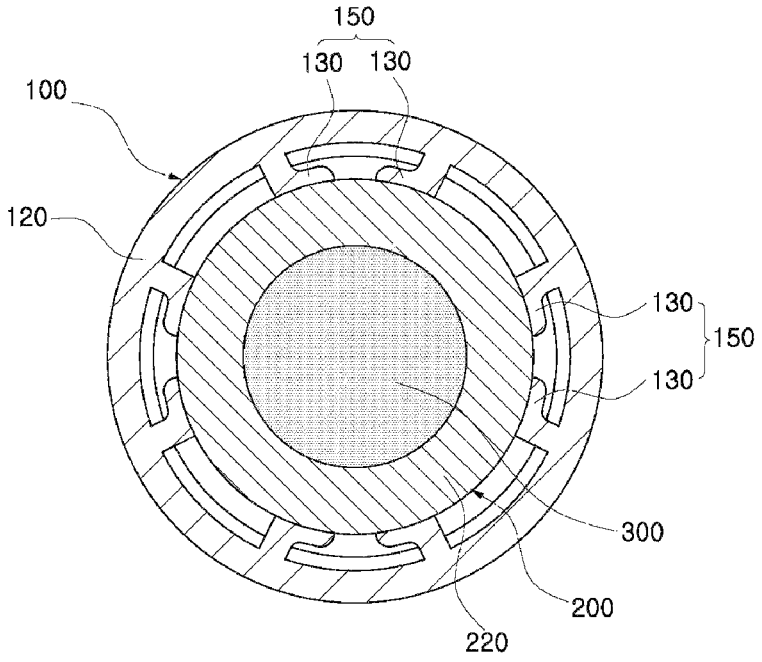
FIG. 10 is a cross-sectional view take along line A-A of FIG. 9.

FIG. 1 is a diagram illustrating the state before components constituting an air permeable cap for a vehicle in accordance with an embodiment of the present disclosure are coupled, FIG. 2 is a cross-sectional view illustrating the state in which the components constituting the air permeable cap for a vehicle in accordance with the embodiment of the present disclosure are coupled, FIG. 3 is a perspective view illustrating a cover part of the air permeable cap for a vehicle in accordance with the embodiment of the present disclosure, FIG. 4 is a cross-sectional perspective view illustrating a foam part of the air permeable cap for a vehicle in accordance with the embodiment of the present disclosure, FIG. 5 is a side view illustrating the air permeable cap for a vehicle in accordance with the embodiment of the present disclosure, FIG. 6 is a cross-sectional view taken along line A-A of FIG. 5, FIG. 7 is another side view illustrating the air permeable cap for a vehicle in accordance with the embodiment of the present disclosure, FIG. 8 is a cross-sectional view taken along line A-A of FIG. 7, FIG. 9 is still another side view illustrating the air permeable cap for a vehicle in accordance with the embodiment of the present disclosure, and FIG. 10 is a cross-sectional view take along line A-A of FIG. 9.

Referring to FIGS. 1 to 10, the air permeable cap for a vehicle in accordance with the embodiment of the present disclosure includes a cover part 100, a foam part 200, a membrane part 300 and an adhesion retention part. The cover part 100 is made of a plastic material and formed in a cylindrical shape with a closed end part 110, and has a plurality of guide ribs 130 radially formed on the inner circumferential surface thereof. The foam part 200 is inserted and installed in the cover part 100 so as to be contacted with the guide ribs 130, has a ventilation hole H formed on one side thereof, and is coupled to a cylindrical opening (not illustrated) formed in a housing (not illustrated) for vehicle parts, and made of a rubber material so as to be elastically deformed. The membrane part 300 is installed between the foam part 200 and the cover part 100, and made of a porous material which blocks a flow of water through the ventilation hole H and allows a flow of air through the ventilation hole H. The adhesion retention part is coupled in a concave-convex shape to retain the adhesion force between the foam part 200 and the cover part 100.

The cover part 100 includes the closed end part 110 and a body part 120. The closed end part 110 is formed substantially in a disk shape, and the body part 120 is formed in a cylindrical shape and connected to the closed end part 110.

As illustrated in FIG. 3, the plurality of guide ribs 130 are radially formed on the inner circumferential surface of the body part 120.

The plurality of guide ribs 130 are each formed to have an L-shaped cross-section except a portion adjacent to the closed end part 110.

A pair of guide ribs 130 are disposed symmetrically with each other to constitute one guide rib group 150, and a plurality of guide rib groups 150 are radially arranged along the inner circumferential surface of the body part 120 of the cover part 100 so as to be spaced by a predetermined distance apart from each other.

The portions of the plurality of guide ribs 130, adjacent to the closed end part 110, indicate portions where spacing protrusions 131 to be described below are formed.

Between the pair of guide ribs 130 constituting one guide rib group 150, a first space S1 for ventilation is formed. The pair of guide ribs 130 may be disposed in the first space S1, such that the L-shaped cross-sections thereof are symmetrical with each other.

The plurality of first spaces S1, each of which is defined by one pair of guide ribs 130 facing each other, may be formed inside the cover part 100, and improve air permeability.

The cover part 100 includes the plurality of guide rib groups 150, each of which is constituted by one pair of guide ribs 130. Between the respective guide rib groups 150, a second space S2 for ventilation is formed. The second space S2 has a larger width than the first space S1. As a ventilation space larger than the first space S1 is provided through the second space S2, the air permeability may be further improved.

Referring to FIGS. 3 and 6, each of the guide ribs 130 includes the spacing protrusion 131 which protrudes toward the center of the cover part 100 so as to space the foam part 200 and the membrane part 300 apart by a predetermined distance from the closed end part 110 of the cover part 100.

As illustrated in FIGS. 2 and 9, a third space S3 for ventilation is formed between the membrane part 300 and the closed end part 110 of the cover part 100 by the plurality of spacing protrusions 131. The air permeability around the membrane part 300 may be improved through the third space S3.

The foam part 200 includes a ventilation part 210 having the ventilation hole H and abutting on the membrane part 300, and a cylindrical coupling part 220 connected to the ventilation part 210. The coupling part 220 has an inclined coupling induction part 240 formed on one side of the inner surface thereof.

The cylindrical opening formed in the housing for vehicle parts may be easily coupled to the foam part 200 through the inclined coupling induction part 240 formed at the coupling part 220 of the foam part 200.

The foam part 200 is made of a rubber material so as to be elastically deformed. Therefore, the cylindrical opening formed in the housing for vehicle parts and the inner circumferential surface of the foam part 200 may adhere to each other so as to block the introduction of water or dust.

Referring to FIGS. 1, 2, 3 and 9, the adhesion retention part includes a ring-shaped adhesion protrusion 230 and a plurality of adhesion grooves 140. The ring-shaped adhesion protrusion 230 is formed along the outer circumference of the coupling part 220 of the foam part 200, and the plurality of adhesion grooves 140 are formed in the respective guide ribs 130 formed in the cover part 100 and coupled to the adhesion protrusion 230.

Since the foam part 200 is made of an elastically deformable rubber material, the portion of the coupling part 220 of the foam part 200, where the adhesion protrusion 230 is formed, may be elastically deformed and inserted to the cover part 100, even though the adhesion protrusion 230 is locked to the cover part 100 while the foam part 200 is coupled to the cover part 100.

After the foam part 200 is inserted into the cover part 100 by a predetermined length, the adhesion protrusion 230 is accurately coupled to the adhesion groove 140. During this process, the elastically deformed foam part 200 is restored to the original shape thereof.

Each of the guide ribs 130 may have an inclined coupling guide 132 formed at an end thereof, and the foam part 200 may be easily inserted and coupled to the cover part 100 through the coupling guide 132.

Through the coupling guide 132, the adhesion protrusion 230 of the foam part 200 may easily enter between the guide ribs 130.

Through the adhesion retention part constituted by the adhesion protrusion 230 and the adhesion grooves 140, the cover part 100 and the foam part 200 may be reliably coupled to each other. Although vibration is generated by an operation of a vehicle or an impact applied to the vehicle, the adhesion force between the cover part 100 and the foam part 200 may be continuously retained, which makes it possible to continuously retain the function of blocking the introduction of water or dust.

As described above, the air permeable cap for a vehicle in accordance with the embodiment of the present disclosure may include the adhesion retention part which is formed in a concave-convex shape to continuously retain the adhesion force between the foam part made of a rubber material and the cover part made of a plastic material, and include the spacing protrusions which space the foam part by a predetermined distance apart from the inner surface of the cover part, with the foam part coupled to the cover part, in order to improve the ventilation function. Furthermore, the guide rib formed on the cover part may expand the flow space between the inner circumferential surface of the cover part and the outer circumferential surface of the foam part, thereby improving the ventilation performance.

Although exemplary embodiments of the disclosure have been disclosed for illustrative purposes, those skilled in the art will appreciate that various modifications, additions and substitutions are possible, without departing from the scope and spirit of the disclosure as defined in the accompanying claims. Thus, the true technical scope of the disclosure should be defined by the following claims.

What is claimed is:

1. An air permeable cap for a vehicle, comprising:

a cover part having a cylindrical shape and comprising a closed end part, an inner circumferential surface and a plurality of guide ribs extending radially from the inner circumferential surface;

a foam part in contact with the plurality of guide ribs and having a ventilation hole;

a membrane part located between the foam part and the cover part, and configured to block a flow of water but allow a flow of air through the ventilation hole; and an adhesion retention part configured to retain an adhesion force between the foam part and the cover part and comprising:

a ring-shaped adhesion protrusion arranged along an outer circumference of the foam part; and a plurality of adhesion grooves arranged in respective guide ribs and configured to engage the ring-shaped adhesion protrusion.

2. The air permeable cap of claim 1, wherein each of the guide ribs includes a spacing protrusion extending toward a center of the cover part and maintaining a gap between the membrane part and the closed end part of the cover part.

3. The air permeable cap of claim 2, wherein the plurality of guide ribs each has an L-shaped cross-section.

4. The air permeable cap of claim 3, wherein:

the plurality of guide ribs comprises a pair of the guide ribs symmetrically disposed to face each other and constituting a guide rib group; and the cover part is configured to establish a first space between the pair of the guide ribs for ventilation.

5. The air permeable cap of claim 1, wherein the foam part comprises an elastically deformable material.

6. The air permeable cap of claim 5, wherein an end of each of the guide ribs is configured to have an inclined coupling guide.

7. The air permeable cap of claim 5, wherein the foam part comprises:

a ventilation part abutting the membrane part; and a cylindrical coupling part connected to the ventilation part.

8. The air permeable cap of claim 7, wherein an end of the inner circumferential surface of the cylindrical coupling part is configured to have an inclined coupling induction part.

9. An air permeable cap, comprising:

a cover part having a cylindrical shape and comprising a closed end part, an inner circumferential surface and a plurality of guide ribs extending radially from the inner circumferential surface;

a foam part in contact with the plurality of guide ribs and having a ventilation hole;

a membrane part located between the foam part and the cover part, and configured to block a flow of water but allow a flow of air through the ventilation hole; and an adhesion retention part configured to retain an adhesion force between the foam part and the cover part, wherein each of the guide ribs includes a spacing protrusion extending toward a center of the cover part and maintaining a gap between the membrane part and the closed end part of the cover part, wherein the plurality of guide ribs each has an L-shaped cross-section, wherein the plurality of guide ribs comprises a pair of the guide ribs symmetrically disposed to face each other and constituting a guide rib group, and the cover part is configured to establish a first space between the pair of the guide ribs for ventilation, and wherein the cover part comprises:

a plurality of guide rib groups, each guide rib group comprising a different pair of the guide ribs symmetrically disposed to face each other; and a second space established between neighboring guide rib groups for ventilation.

10. The air permeable cap of claim 9, wherein a width of the second space is greater than that of the first space.

11. The air permeable cap of claim 10, wherein the plurality of guide rib groups is radially arranged on the inner circumferential surface of the cover part and spaced apart from each other.

* * * * *